US006782842B1

(12) United States Patent
Alvord

(10) Patent No.: US 6,782,842 B1
(45) Date of Patent: Aug. 31, 2004

(54) BOAT-LIFT SYSTEMS AND METHODS

(76) Inventor: Jeff Alvord, 176 Ten Mile Rd., Lynden, WA (US) 98264

( * ) Notice: Subject to any disclaimer, the term of this patent is extended or adjusted under 35 U.S.C. 154(b) by 0 days.

(21) Appl. No.: 10/337,814

(22) Filed: Jan. 6, 2003

(51) Int. Cl.[7] ..... B63B 23/02
(52) U.S. Cl. ..... 114/369; 114/259
(58) Field of Search ..... 114/258, 259, 114/368, 369, 366, 373, 343, 44, 48

(56) References Cited

U.S. PATENT DOCUMENTS

| | | | | |
|---|---|---|---|---|
| 3,647,089 | A | 3/1972 | Christensen | |
| 4,627,377 | A | 12/1986 | Zoonens | |
| 4,763,593 | A | 8/1988 | Lasko | |
| 4,864,951 | A | 9/1989 | Koepp, Jr. | |
| 4,878,450 | A | 11/1989 | Schmidt, Jr. | |
| 5,133,275 | A | 7/1992 | Maurizio | |
| 5,193,479 | A | 3/1993 | Bielefeld | |
| 5,483,912 | A | 1/1996 | Thomas | |
| 5,544,606 | A | 8/1996 | Schmidt, Jr. | |
| 5,636,587 | A | 6/1997 | Klimowicz | |
| 5,937,783 | A | 8/1999 | Costa | |
| 6,038,994 | A * | 3/2000 | Ford et al. | 114/259 |
| 6,047,659 | A | 4/2000 | Schmidt, Jr. | |
| 6,327,992 | B1 | 12/2001 | Martin | |
| 6,474,256 | B1 * | 11/2002 | Vogel | 114/368 |
| 6,502,525 | B2 * | 1/2003 | Burke | 114/259 |

FOREIGN PATENT DOCUMENTS

| | | |
|---|---|---|
| EP | 0153248 | 8/1985 |

OTHER PUBLICATIONS

FREEDOMLIFT™; *FreedomLift™ The Ideal Solution;* Internet Website www.freedomlift.com/features.htm; 2002; 4 pages; U.S.

* cited by examiner

*Primary Examiner*—S. Joseph Morano
*Assistant Examiner*—Lars A. Olson
(74) *Attorney, Agent, or Firm*—Michael R. Schacht; Schacht Law Office, Inc.

(57) ABSTRACT

A boat-lift system adapted to move a smaller boat relative to a larger boat. The boat-lift system comprises a structural support, a lift structure, a pivot system, and an actuator assembly. The structural support is adapted to be rigidly connected to a transom of the larger boat. The lift structure defines a second pivot portion, an actuator portion, an extension portion, and first and second boat-engaging portions. The pivot system connects the first and second pivot portions to allow rotation of the lift structure between first and second lift positions relative to the structural support. Actuation of the actuator assembly causes the lift structure to move between the first and second lift positions. When the smaller boat is in a docking position adjacent to the lift structure, operation of the actuator assembly moves the lift structure to lift the smaller boat from the docking position to a first storage position.

22 Claims, 3 Drawing Sheets

BOAT-LIFT SYSTEMS AND METHODS

FIELD OF THE INVENTION

The present invention relates to boat-lift systems and methods and, more particularly, to boat-lift systems and methods adapted to lift a small boat out of the water for stowage on a larger boat.

BACKGROUND OF THE INVENTION

Operators of relatively large boats (i.e., over twenty-five feet long) often use smaller, more mobile boats for certain activities or to reach locations not accessible to the larger boats. When not in use, these smaller boats are often stowed aboard the larger boat.

A number of systems are known for lifting a smaller boat out of the water and into a storage position on a larger boat. One such system will be referred to herein as a davit system. A davit system comprises two uprights that are swung out over the side of the larger boat to raise and lower the smaller boat. With the smaller boat in the raised position, the uprights are typically swung back to place the smaller boat in a stowed position. Davit systems occupy a substantial amount of deck area on the larger boat and are relatively complex and expensive.

A swim step is typically mounted to the transom of larger boats. The swim step comprises a flat step surface supported just above the water line. An operator can stand on the step surface when accessing, entering, or exiting the water. Some boat-lift systems make use of the swim step as support for the lift system and/or as a storage location for the smaller boat. For example, a winch may be mounted at the stern of the larger boat. The winch is connected to cables that extend around the smaller boat, and operation of the winch displaces the cables to lift the smaller boat onto the swim step. Swim steps are not necessarily designed to accommodate the weight of the smaller boat, and the winches and cables can interfere with use of the stern and swim step of the larger boat.

RELATED ART

The following references were turned up in a professional patentability search conducted on behalf of the Applicant.

U.S. Pat. No. 5,937,783 to Costa, U.S. Pat. No. 5,483,912 to Thomas, U.S. Pat. No. 5,193,479 to Bielefeld, U.S. Pat. No. 5,133,275 to Maurizio, and U.S. Pat. No. 4,864,951 to Koepp, Jr. all teach davit systems for hoisting small boats onto a swim platform of a larger boat. In each of these patents, a member or assembly is rotatably attached to the end of the swim platform distal from the larger boat. All of these systems use cables to pull either the boat or the rotatable member or assembly from a loading position to a storage position.

U.S. Pat. No. 3,647,089 to Christiansen patent describes a system that it is pivotably supported by a swim step mounted on the transom of a larger boat. However, the device disclosed in the Christiansen patent employs bumpers that engage the side of the smaller craft and a frame that extends over the top of the smaller craft. The smaller craft is lifted from above rather than from below. The Christiansen device also employs winches and cables, is supported by the swim step, and obstructs access to the swim step.

U.S. Pat. No. 4,627,377 to Zooens, U.S. Pat. No. 6,327,992 to Martin, U.S. Pat. No. 5,636,587 to Klimowicz, and U.S. Pat. No. 4,763,593 to Lasko disclose davit systems that are pivotably connected at a pivot point at or near the transom of a larger boat. The systems disclosed in these patents rotate between loading and stored positions in a manner that would inhibit the use of a conventional swim platform.

The Applicant is further aware of a boat-lift product sold under the tradename FreedomLift. The FreedomLift product employs a pivot point adjacent to the transom of the larger boat. A lift structure extends from the pivot point and is moved between upper and lower positions to raise and lower the smaller boat to the rear of the swim step.

SUMMARY OF THE INVENTION

The present invention may be embodied as a boat-lift system adapted to move a smaller boat relative to a larger boat. Typically, a swim step is secured to the stern of the larger boat, and the swim step defines an aft edge and a swim step surface. The boat-lift system comprises a structural support, a lift structure, a pivot system, and an actuator assembly.

The structural support defines a first pivot portion and is adapted to be rigidly connected to the transom of the larger boat. So connected, the first pivot portion is arranged below the swim step surface and forward of the aft edge of the swim step. The lift structure defines a second pivot portion, an actuator portion, an extension portion, and first and second boat-engaging portions extending from the extension portion. The pivot system connects the first and second pivot portions to allow rotation of the lift structure between first and second lift positions relative to the structural support. The actuator assembly is secured at a first end relative to the structural support and at a second end to the actuator portion of the lift structure. Actuation of the actuator assembly in a first mode causes the lift structure to move from the second lift position to the first lift position.

When the lift structure is in the first lift position, the first boat-engaging portion extends over the swim step surface and the second boat-engaging portion extends rearwardly beyond the aft edge of the swim step. When the lift structure is in the second lift position, the first boat-engaging portion is spaced rearwardly of the aft edge of the swim step surface and the second boat-engaging portion extends below the first boat-engaging portion.

Accordingly, when the smaller boat is in a docking position adjacent to the lift structure and the actuator assembly is operated in the first mode, the lift structure moves the smaller boat from the docking position to a first storage position relative to the larger boat.

The lift structure may further be an assembly comprising a pivot member and a lift member. The pivot member defines the pivot portion, the actuator portion, and a socket portion. The lift member defines the extension portion and the first and second boat-engaging portions. The lift member is detachably attached to the pivot member to allow the lift member to be removed and stored when the boat-lift system is not in use.

The present invention may be embodied as a method comprising the steps of providing a structural support, a lift structure, a pivot system, and an actuator assembly and connecting and operating these structural elements.

DETAILED DESCRIPTION OF THE PREFERRED EMBODIMENT

Figure 1:
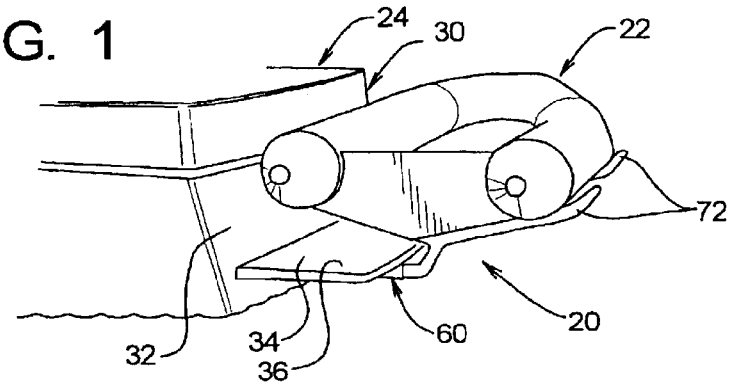
FIG. 1 is a perspective view of a larger boat employing a boat-lift system of the present invention to support a smaller boat in a first stowage position.

FIG. 1 depicts a boat-lift system 20 constructed in accordance with, and embodying, the principles of the present invention. The boat-lift system 20 is used to stow a smaller boat 22 on a larger boat 24.

FIG. 1 depicts the boat-lift system 20 mounted to a stern 30 of the larger boat 24. More specifically, the larger boat 24 defines a transom 32 to which the boat-lift system 20 is attached. As is conventional, the larger boat 24 comprises a swim step 34 that is also mounted to the transom 32 and which extends rearwardly from the stern 30. The swim step 34 defines a swim step surface 36 that is, under normal conditions, substantially parallel to the surface of the water. The swim step 34 further defines an aft edge 38 distal from the transom 32. The swim step 34 is not required to implement the present invention and is described herein only to the extent necessary for a complete understanding thereof.

The smaller boat 22 is or may be conventional. The exemplary smaller boat 22 comprises a V-shaped hull 40 and port and starboard pontoons 42 and 44 and a keel 46. The use of the exemplary smaller boat 22 is typical, but boats of roughly the same size and employing other construction techniques and hull shapes can also be accommodated by the boat-lift system 20.

Figure 3:
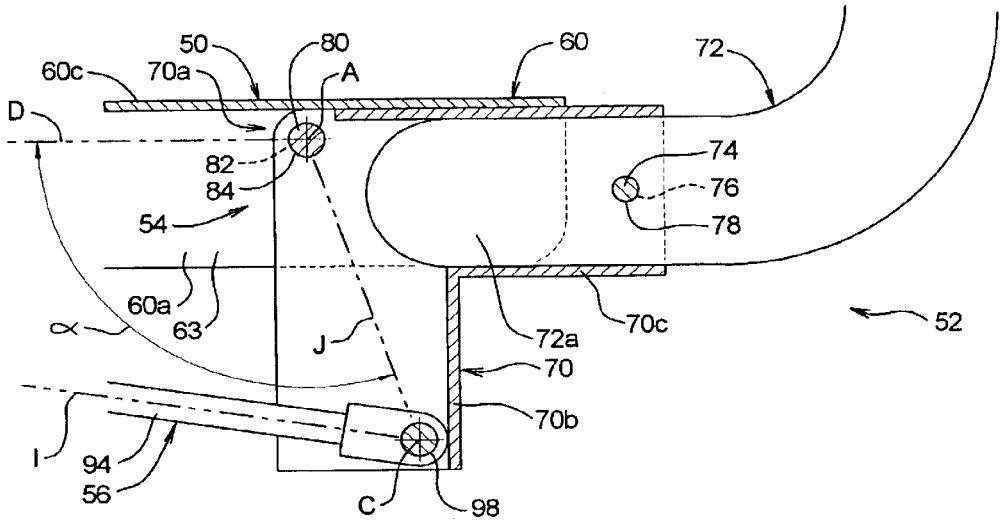
FIG. 3 is a side elevation view depicting portions of a lift structure of the boat-lift system depicted in FIG. 1.
Figure 4:
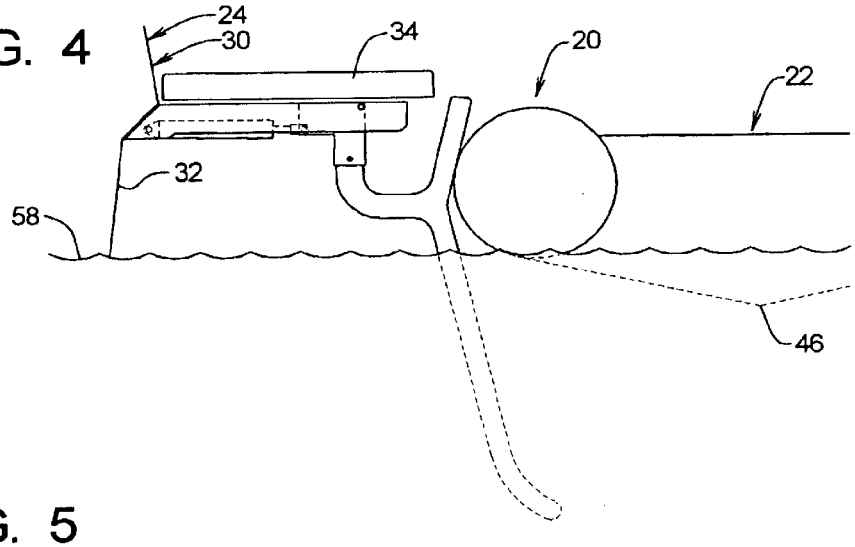
FIG. 4 is a side elevation view depicting the boat-lift system of FIG. 1 in a second configuration relative to the larger boat.
Figure 5:
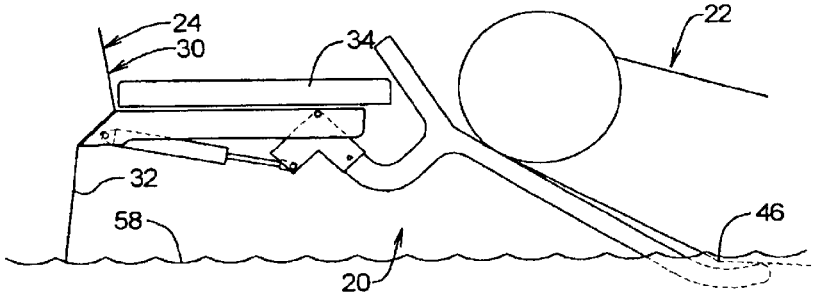
FIG. 5 is a side elevation view depicting the boat-lift system of FIG. 1 in an intermediate configuration between the first and second configurations.

The boat lift system 20 comprises a structural support assembly 50, a lift structure 52, a pivot system 54, and an actuator assembly 56. The pivot system 54 pivotably mounts the lift structure 52 to the structural assembly 50. The actuator assembly 56 is connected between a fixed location such as the structural support assembly 50 and the lift structure 52. Operation of the actuator assembly 56 causes the lift structure 52 to rotate relative to the structural support assembly 50 between a first lift position (FIGS. 1, 2, 3, and 6) and a second lift position (FIG. 4). FIG. 5 depicts the lift structure 52 in an intermediate position between the first and second lift positions.

Figure 2:
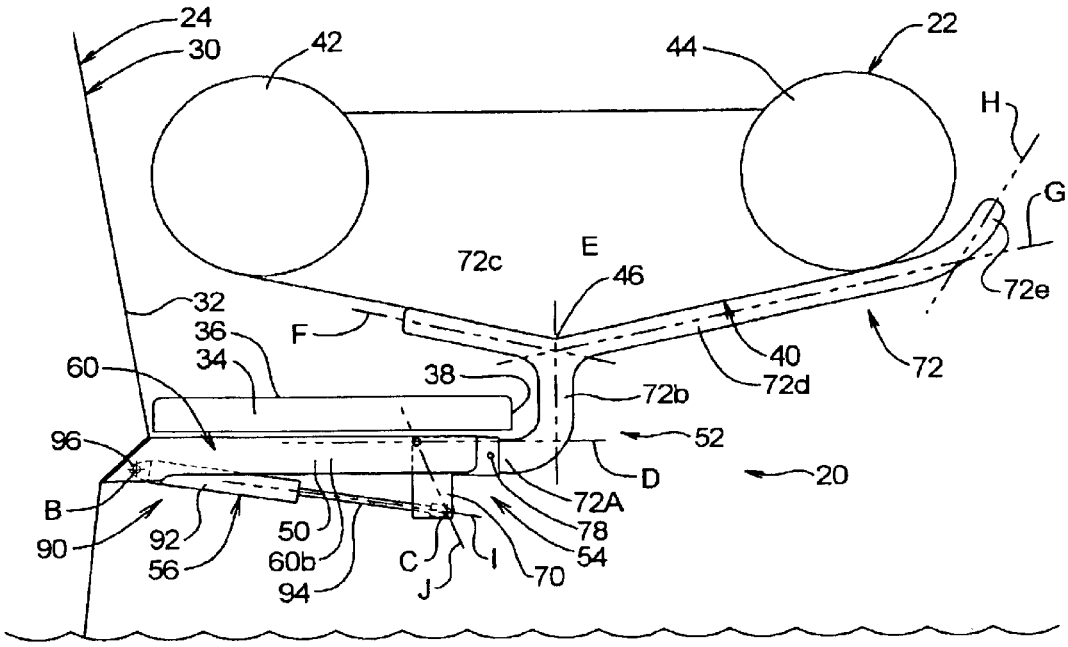
FIG. 2 is a side elevation view depicting the boat-lift system of FIG. 1 in a first configuration relative to the larger boat.
Figure 6:
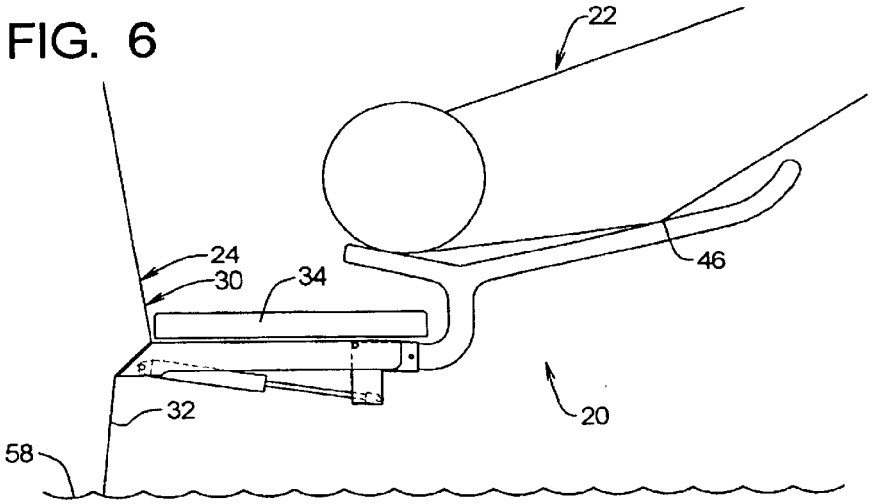
FIG. 6 is a side elevation view depicting the boat-lift system of FIG. 1 in the first configuration relative to the larger boat, with the smaller boat being supported in a second stowage position.

To lift the smaller boat 22 out of the water, the lift structure 52 is first placed in the second lift position. The smaller boat 22 is then arranged in a docking position adjacent to the lift structure 52 as shown in FIG. 4. The lift structure 52 is then moved into the first position, engaging the smaller boat 22 and lifting it out of the water as shown in FIG. 5 and into a first storage position as shown in FIG. 6. The smaller boat 22 may then be pulled by hand into a second storage position as shown in FIGS. 1 and 2. The smaller boat will typically be secured with lines in the first and second storage positions.

To place the smaller boat 22 into the water, the lift structure 52 is moved from the first lift position into the second lift position. The smaller boat 22 will slide under control out of either of the first or second storage positions into the water; the smaller boat 22 will be in the docking position when it enters the water.

The details of construction and operation of the boat-lift system 20 will now be described in detail with reference to FIGS. 2 and 3.

The exemplary structural support assembly 50 comprises first and second support members 60 and 62. The size, shape, and materials of the support members 60 and 62 are not critical to a particular implementation of the present invention. The support members 60 and 62 are capable of bearing the loads associated with the lift system 20 and the smaller boat 22. In some configurations, the support members 60 and 62 may also be engineered to support the swim platform 34; in most configurations, the swim platform 34 will have its own support system separate from that of the boat-lift system 20.

In the exemplary boat-lift system 20, the support members 60 and 62 are preferably identical, but these members need not be identical. Only the port support member 60 will be described herein in detail, with the understanding that the following discussion also applies to the support member 62.

The support members 60 and 62 are made of metal bent into the shape of an inverted "U" to define a first side wall 60*a*, second side wall 60*b*, and upper wall 60*c*. A slot 62 is formed below the upper wall 60*c* and between the side walls 60*a* and 60*b*. One end of the support members 60 is adapted to be bolted, adhered, and/or otherwise securely affixed to, the transom 32 of the larger boat 24. The exact means for securing the support members 60 to the transom 32 are not important as long as the support members 60 are capable of bearing the loads of the boat-lift system 20 constructed in accordance with the principles of the present invention.

The exemplary lift structure 52 comprises two pivot members 70 and two lift members 72. Each lift member 72 is detachably attached to one of the pivot members 70 by a lock pin 74.

As seen in FIGS. 1, 2, and 4–6, The lift member 72 is the only portion of the boat-lift system 20 that is not under the swim step 34. By removing the lock pin 74, the lift member 72 can be detached from the pivot member 70 and stowed away. When the lift member 72 is stowed away, no portion of the boat-lift system 20 is visible during normal use of the larger boat 24, and the larger boat 24 and swim step 34 may be used as if no boat-lift system 20 is installed thereon.

Although preferred, the use of a two-piece lift structure 52 is optional. The present invention may be implemented with a lift structure made of a unitary member or, alternatively, a lift structure of more than two pieces that can be broken down or disassembled for compact storage and shipping. The preferred two-piece lift structure 52 represents a good compromise of rigidity, simplicity, and ease of storage when not in use.

The two pivot members 70 are preferably the same as each other. The exemplary lift members 72 are also the same as each other. The pivot members 70 and lift members 72 can, however, be different in other embodiments of the present invention.

The exemplary pivot members 70 are generally L-shaped tubular metal members each defining a pivot portion 70*a*, an actuator portion 70*b*, and a socket portion 70*c*. The pivot portion 70*a* is formed by the corner of the pivot member 70. The actuator portion 70*b* is formed by one leg and the socket portion 70*c* is formed by the other leg of the member 70. The pivot members 70 are sized and dimensioned to be received within the slot 63 defined by either of the support members 60 and 62.

The lift members 72 are tubular metal members each defining a first to extension segment 72*a*, a second extension segment 72*b*, a first boat-engaging segment 72*c*, a second boat-engaging segment 72*d*, and a tip segment 72*e*.

The first extension portion 72*a* is adapted to be received by the socket portion 70*c* of the pivot member 70 to prevent movement of the lift member 72 relative to the pivot member 70 except along a lock axis. The lock pin 74 extends through first and second socket openings 76 formed in opposite side walls of the socket portion 70*c* and first and second extension openings 78 formed in opposite side walls of the first extension portion 72*a* of the lift member 72.

With the first extension portion 72*a* within the socket portion 70*b* and the holes 76 and 78 aligned, the lock pin 74 is inserted through the openings 76 and 78. The lock pin 74 thus prevents relative movement of the lift member 72 along the lock axis relative to the pivot member 70. However, removing the lock pin 74 from the openings 76 and 78 allows the first extension 72*a* to be removed from the socket portion 70*b* along the lock axis and thus allows the lift structure 52 to be disassembled as described above.

The pivot system 54 is formed by a pivot pin 80, first and second support openings 82 formed in the support member 60, and first and second lift openings 84 formed in the pivot portion 70*a* of the pivot member 70. With the support openings 82 aligned with the lift openings 84, the pivot pin 80 is inserted through these openings 82 and 84. The pivot pin 80 defines a pivot axis A about which the pivot member 70 rotates relative to the support member 60.

More specifically, with the pivot member 70 received within the slot 63 defined by the support member 60 and the pivot pin 80 inserted through the openings 82 and 84, the pivot member 70 is allowed to rotate within a limited arc relative to the support member 60. In the preferred embodiment, this limited arc is approximately 90 degrees. A first boundary of the arc corresponds to the first lift position and a second boundary corresponds to the second lift position.

The actuator assemblies 56 form a part of a hydraulic system 90. Each actuator assembly 56 comprises a cylinder 92 and a rod 94. The hydraulic system 90 is configured such that operation of a first button (not shown) causes the rods 94 to extend from the cylinders 92 and operation of a second button (not shown) causes the rods 94 to retract into the cylinders 92. Such hydraulic systems and actuator assemblies are well-known in the art, and the actuator assemblies 56 and hydraulic system 90 will not be described herein in further detail.

The cylinder 92 is connected to the support member 60 by a cylinder pin 96; the pin 96 allows the cylinder 92 to rotate about a cylinder axis B relative to the support member 60. Similarly, the rod 94 is connected to the actuator portion 70*b* of the pivot member 70 by a rod pin 98. The rod pin 98 allows the rod 94 to rotate about a rod pin axis C relative to the pivot member 70. The actuator assembly 56, support member 60, and actuator portion 70*b* thus generally define three sides of an actuator triangle, and extension and retraction of the rod 94 changes the interior angles of the actuator triangle.

The operation of the boat-lift system 20 might be better understood with reference to various axes defined by the components of this system 20, in addition to the axes A, B, and C defined by the pivot pin 80, cylinder pin 96, and rod pin 98, respectively. In particular, the first extension portion 72*a* defines a first extension axis D, and the second extension portion 72*b* defines a second extension axis E. The first boat engaging portion 72*c* defines a first boat extension axis F, while the second boat engaging portion 72*d* defines a second boat extension axis G. The lift member tip portion 72*e* defines a tip axis H. Finally, an actuator axis I is defined by the actuator assembly 56, and a displacement axis J intersects the pivot axis A and the rod pin axis C.

The actuator triangle is more specifically defined by the first extension axis D, the actuator axis I, and the displacement axis J. Extension and retraction of the actuator assembly 56 causes a displacement angle $\alpha$ between the first extension axis D and the displacement axis J to change. In the preferred embodiment, this displacement angle $\alpha$ is approximately 110 degrees when the lift structure 52 is in the first lift position and approximately 20 degrees when the lift structure 52 is in the second lift position.

The displacement angle thus allows the pivot member 70 to rotate through an angle of approximately 90 degrees. The pivot member 70 can be made to rotate through an angle in a first preferred range of approximately 80 to 100 degrees and in any event should rotate through an angle in a second preferred range of approximately 60 to 180 degrees.

The first and second extension axes D and E, first and second boat-engaging axes F and G, and tip axis H are all fixed relative to each other. The following Table A sets forth the preferred approximate angular relationships between certain of these axes and first and second preferred approximate ranges of these angular relationships. All angles are in degrees.

| Definition of Angular Relationship | Preferred Angle | First Preferred Range | Second Preferred Range |
|---|---|---|---|
| between axes D and E | 90 | 60–120 | 40–140 |
| between axes E and F | 75 | 70–80 | 50–90 |
| between axes E and G | 75 | 70–80 | 50–90 |
| between axes G and H | 40 | 30–50 | 0–90 |
| between axis D and horizontal | 0 | 0 ± 10 | 0 ± 20 |

The lift structure 52 is thus supported by the pivot system 54 from the structural support assembly 50 and rotated by the actuator assembly 56 to lift the smaller boat 22 out of the water 58 or to place the smaller boat 22 into the water 58. When the lift structure 52 is in the first lift position, the shape of the lift structure 52 allows the smaller boat 22 to be stowed above the swim step 34 adjacent to the stern 30 of the larger boat 24. But when the lift structure 52 is in the second lift position, the upper surface 36 of the swim step 34 is essentially unobstructed. In addition, in the second lift position, the lift members 72 are mostly underwater and do not form a substantial obstruction at the aft edge 38 of the swim step 38. To the contrary, ladder rungs may be formed on the lift member 72 so that the lift member 72 can be used as a swim ladder for swimmers entering or exiting the water 58.

It will be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

I claim:

1. A boat-lift system adapted to move a smaller boat relative to a larger boat comprising a swim step, where the swim step defines an aft edge and a swim step surface and extends from a transom of the larger boat, the boat-lift system comprising:

a fixed structural support defining a first pivot portion, wherein the structural support is adapted to be rigidly connected to the transom of the larger boat such that the first pivot portion is arranged below the swim step surface and forward of the aft edge of the swim step;

a lift structure defining a second pivot portion, an actuator portion, an extension portion, and first and second boat-engaging portions extending from the extension portion;

a pivot system for connecting the first and second pivot portions to allow rotation of the lift structure between first and second lift positions relative to the structural support about a pivot axis defined by the first pivot portion of the structural support; and an actuator assembly secured at a first end relative to the structural support and at a second end to the actuator portion of the lift structure, wherein actuation of the actuator assembly in a first mode causes the lift structure to rotate about the pivot axis from the second lift position to the first lift position, wherein when the lift structure is in the first lift position, the first boat-engaging portion extends over the swim step surface and the second boat-engaging portion extends rearwardly beyond the aft edge of the swim step, when the lift structure is in the second lift position, the first boat-engaging portion is spaced rearwardly of the aft edge of the swim step surface and the second boat-engaging portion extends below the first boat-engaging portion, and when the smaller boat is in a docking position adjacent to the lift structure and the actuator assembly is operated in the first mode, the lift structure moves the smaller boat from the docking position to a first storage position relative to the larger boat.

2. A boat-lift system as recited in claim 1, in which the lift structure comprises:

a pivot member defining the pivot portion, the actuator portion, and a socket portion; and a lift member defining the extension portion and the first and second boat-engaging portions, wherein the lift member is detachably attached to the pivot member.

3. A boat-lift system as recited in claim 1, in which:

the extension portion of the lift structure comprises first and second extension portions that are angled with respect to each other; and the first extension portion spaces the second extension portion from the pivot portion such that the second extension portion is rearward of the aft edge of the swim step when the lift structure is in the first lift position.

4. A boat-lift system as recited in claim 3, in which:

the pivot system defines a pivot axis;

the first extension portion defines a first extension axis extending through the pivot axis; and the second extension portion defines a second extension axis, whereby an angle between the first and second extension axes is substantially between approximately 60 and 120 degrees.

5. A boat-lift system as recited in claim 4, in which the angle between the first and second extension axes is approximately 90 degrees.

6. A boat-lift system as recited in claim 3, in which:

the pivot system defines a pivot axis;

the first extension portion defines a first extension axis extending through the pivot axis; and the actuator portion defines a displacement axis extending through the pivot axis; whereby an angle between the first extension axis and the displacement axis is substantially between approximately 90 and 130 degrees when the lift structure is in the first position, and approximately 0 and 40 degrees when the lift structure is in the second position.

7. A boat-lift system as recited in claim 3, in which the first extension axis is substantially horizontal and the second extension axis is substantially vertical when the lift structure is in the first lift position.

8. A boat-lift system as recited in claim 3, in which the first extension axis is substantially vertical and the second extension axis is substantially horizontal when the lift structure is in the second lift position.

9. A boat-lift system as recited in claim 7, in which the first extension axis is substantially vertical and the second extension axis is substantially horizontal when the lift structure is in the second lift position.

10. A boat-lift system as recited in claim 1, in which:

the boat-lift system comprises first and second structural supports, first and second lift structures, first and second pivot systems, and first and second actuator assemblies;

the first and second pivot systems define a pivot axis extending through the pivot portions; and operation of the first and second actuator assemblies causes the first and second lift structures to rotate about the pivot axis together between the first and second lift positions relative to the first and second structural supports.

11. A method of moving a smaller boat relative to a larger boat having a swim step, the method comprising the steps of:

providing a structural support defining a support portion;

rigidly connecting the structural support relative to a transom of the larger boat such that the support portion is arranged below a surface of the swim step and forward of an aft edge of the swim step;

providing a lift structure defining a pivot portion, an actuator portion, an extension portion, and first and second boat-engaging portions extending from the extension portion;

connecting the support portion and the pivot portion to allow rotation of the lift structure between first and second lift positions relative to the structural support about a pivot axis defined by the support portion of the structural support, wherein when the lift structure is in the first lift position, the first boat-engaging portion extends over the swim step surface and the second boat-engaging portion extends rearwardly beyond the aft edge of the swim step, and when the lift structure is in the second lift position, the first boat-engaging portion is spaced rearwardly of the aft edge of the swim step surface and the second boat-engaging portion extends below the first boat-engaging portion;

securing an actuator assembly at a first end relative to the structural support and at a second end to the actuator portion of the lift;

operating the actuator assembly to rotate the lift structure about the pivot axis to place the lift structure in the second lift position;

arranging the smaller boat adjacent to the lift structure;

operating the actuator assembly to cause the lift structure to rotate from the second lift position to the first lift position about the pivot axis to place the lift structure such that the lift structure moves the smaller boat from the docking position to a first storage position relative to the larger boat.

12. A method as recited in claim 11, in which the step of providing the lift structure comprises the steps of:

providing a pivot member defining the pivot portion, the actuator portion, and a socket portion;

providing a lift member defining the extension portion and the first and second boat-engaging portions; and detachably attaching the lift member to the pivot member.

13. A method as recited in claim 11, in which:

the step of providing the structural support comprises the steps of providing first and second structural supports;

the step of providing the lift structure comprises the steps of providing first and second lift structures;

the step of providing the pivot system comprises the steps of providing first and second pivot systems;

the step of providing the actuator assembly comprises the steps of providing first and second actuator assemblies; and operating the first and second actuator assemblies together to cause the first and second lift structures to rotate together about a common pivot axis between the first and second lift positions relative to the first and second structural supports.

14. A boat-lift system adapted to move a smaller boat relative to a larger boat comprising a swim step, where the swim step defines an aft edge and a swim step surface and extends from a transom of the larger boat, the boat-lift system comprising:

first and second structural supports each defining a support portion, wherein the structural supports are adapted to be rigidly connected to the transom of the larger boat such that the support portion is arranged below the swim step surface and forward of the aft edge of the swim step;

first and second lift structures each defining a pivot portion, an actuator portion, wherein the actuator portion of the lift structure is spaced along a displacement axis extending through the pivot portion, an extension portion comprising a first segment extending along a first extension axis, where the first extension axis extends through the lift pivot portion and is angled relative to the displacement axis, and a second segment extending along a second extension axis, where the second extension axis extends is angle with respect to the first extension axis and is spaced from the pivot portion, and first and second boat-engaging portions extending from the extension portion;

first and second pivot systems for connecting the support portions of the structural supports with the pivot portions of the lift structures to allow rotation of the lift structures about a pivot axis defined by the support portions of the structural supports between first and second lift positions relative to the structural supports; and at least one actuator assembly secured at a first end relative to one of the structural supports and at a second end to the actuator portion of at least one of the lift structures, wherein actuation of the actuator assembly causes the lift structures to rotate about the pivot axis between the first and second lift positions, wherein when the lift structures are in the first lift position, the first boat-engaging portions extend over the swim step surface and the second boat-engaging portions extend rearwardly beyond the aft edge of the swim step, when the lift structures are in the second lift position, the first boat-engaging portions are spaced rearwardly of the aft edge of the swim step surface and the second boat-engaging portions extend below the first boat-engaging portions, and when the smaller boat is in a docking position adjacent to the lift structures, operation of the actuator assemblies causes the lift structures to move the smaller boat from the docking position to a first storage position relative to the larger boat.

15. A boat-lift system as recited in claim 14, in which each lift structure comprises:

a pivot member defining the pivot portion, the actuator portion, and a socket portion; and a lift member defining the extension portion and the first and second boat-engaging portions, wherein the socket portion receives the first segment of the extension portion of the lift member to detachably attach the lift member to the pivot member.

16. A boat-lift system as recited in claim 14, in which an angle between the first and second segments of the extension portion is substantially between approximately 30 and 120 degrees.

17. A boat-lift system as recited in claim 14, in which an angle between the first and second segments of the extension portion is approximately 90 degrees.

18. A boat-lift system as recited in claim 14, in which:

the first segment is substantially horizontal and the second segment is substantially vertical when the lift structure is in the first lift position; and the first segment is substantially vertical and the second segment is substantially horizontal when the lift structure is in the second lift position.

19. A boat-lift system adapted to move a smaller boat relative to a larger boat comprising a swim step, where the swim step defines an aft edge and a swim step surface and extends from a transom of the larger boat, the boat-lift system comprising:

a structural support defining a first pivot portion, wherein the structural support is adapted to be rigidly connected to the transom of the larger boat such that the first pivot portion is arranged below the swim step surface and forward of the aft edge of the swim step;

a lift structure defining a second pivot portion, an actuator portion, an extension portion, and first and second boat-engaging portions extending from the extension portion, where the extension portion of the lift structure comprises first and second extension portions that are angled with respect to each other, and the first extension portion spaces the second extension portion from the pivot portion such that the second extension portion is rearward of the aft edge of the swim step when the lift structure is in the first lift position;

a pivot system for connecting the first and second pivot portions to allow rotation of the lift structure between first and second lift positions relative to the structural support; and an actuator assembly secured at a first end relative to the structural support and at a second end to the actuator portion of the lift structure, wherein actuation of the actuator assembly in a first mode causes the lift structure to move from the second lift position to the first lift position; wherein when the lift structure is in the first lift position, the first boat-engaging portion extends over the swim step surface and the second boat-engaging portion extends rearwardly beyond the aft edge of the swim step;

when the lift structure is in the second lift position, the first boat-engaging portion is spaced rearwardly of the aft edge of the swim step surface and the second boat-engaging portion extends below the first boat-engaging portion;

when the smaller boat is in a docking position adjacent to the lift structure and the actuator assembly is operated in the first mode, the lift structure moves the smaller boat from the docking position to a first storage position relative to the larger boat; and the first extension axis is substantially horizontal and the second extension axis is substantially vertical when the lift structure is in the first lift position.

20. A boat-lift system as recited in claim 19, in which the first extension axis is substantially vertical and the second extension axis is substantially horizontal when the lift structure is in the second lift position.

21. A boat-lift system adapted to move a smaller boat relative to a larger boat comprising a swim step, where the swim step defines an aft edge and a swim step surface and extends from a transom of the larger boat, the boat-lift system comprising:

a structural support defining a first pivot portion, wherein the structural support is adapted to be rigidly connected to the transom of the larger boat such that the first pivot portion is arranged below the swim step surface and forward of the aft edge of the swim step, where the extension portion of the lift structure comprises first and second extension portions that are angled with respect to each other, and the first extension portion spaces the second extension portion from the pivot portion such that the second extension portion is rearward of the aft edge of the swim step when the lift structure is in the first lift position;

a lift structure defining a second pivot portion, an actuator portion, an extension portion, and first and second boat-engaging portions extending from the extension portion;

a pivot system for connecting the first and second pivot portions to allow rotation of the lift structure between first and second lift positions relative to the structural support; and an actuator assembly secured at a first end relative to the structural support and at a second end to the actuator portion of the lift structure, wherein actuation of the actuator assembly in a first mode causes the lift structure to move from the second lift position to the first lift position; wherein when the lift structure is in the first lift position, the first boat-engaging portion extends over the swim step surface and the second boat-engaging portion extends rearwardly beyond the aft edge of the swim step;

when the lift structure is in the second lift position, the first boat-engaging portion is spaced rearwardly of the aft edge of the swim step surface and the second boat-engaging portion extends below the first boat-engaging portion;

when the smaller boat is in a docking position adjacent to the lift structure and the actuator assembly is operated in the first mode, the lift structure moves the smaller boat from the docking position to a first storage position relative to the larger boat; and the first extension axis is substantially vertical and the second extension axis is substantially horizontal when the lift structure is in the second lift position.

22. A boat-lift system adapted to move a smaller boat relative to a larger boat comprising a swim step, where the swim step defines an aft edge and a swim step surface and extends from a transom of the larger boat, the boat-lift system comprising:

first and second structural supports each defining a support portion, wherein the structural supports are adapted to be rigidly connected to the transom of the larger boat such that the support portion is arranged below the swim step surface and forward of the aft edge of the swim step;

first and second lift structures each defining a pivot portion, an actuator portion, wherein the actuator portion of the lift structure is spaced along a displacement axis extending through the pivot portion, an extension portion comprising a first segment extending along a first extension axis, where the first extension axis extends through the lift pivot portion and is angled relative to the displacement axis, and a second segment extending along a second extension axis, where the second extension axis extends is angle with respect to the first extension axis and is spaced from the pivot portion, and first and second boat-engaging portions extending from the extension portion;

first and second pivot systems for connecting the support portions of the structural supports with the pivot portions of the lift structures to allow rotation of the lift structures between first and second lift positions relative to the structural supports; and at least one actuator assembly secured at a first end relative to one of the structural supports and at a second end to the actuator portion of at least one of the lift structures, wherein actuation of the actuator assembly causes the lift structures to move between the first and second lift positions; wherein when the lift structures are in the first lift position, the first boat-engaging portions extend over the swim step surface and the second boat-engaging portions extend rearwardly beyond the aft edge of the swim step;

when the lift structures are in the second lift position, the first boat-engaging portions are spaced rearwardly of the aft edge of the swim step surface and the second boat-engaging portions extend below the first boat-engaging portions;

when the smaller boat is in a docking position adjacent to the lift structures, operation of the actuator assemblies causes the lift structures to move the smaller boat from the docking position to a first storage position relative to the larger boat;

the first segment is substantially horizontal and the second segment is substantially vertical when the lift structure is in the first lift position; and the first segment is substantially vertical and the second segment is substantially horizontal when the lift structure is in the second lift position.

* * * * *